US010513013B2

(12) United States Patent
Huang et al.

(10) Patent No.: US 10,513,013 B2
(45) Date of Patent: Dec. 24, 2019

(54) FINGER RATCHET TOOL

(71) Applicants: Zi-Yan Huang, Taichung (TW); Yao-Lin Cho, Taichung (TW)

(72) Inventors: Zi-Yan Huang, Taichung (TW); Yao-Lin Cho, Taichung (TW)

( * ) Notice: Subject to any disclaimer, the term of this patent is extended or adjusted under 35 U.S.C. 154(b) by 333 days.

(21) Appl. No.: 15/621,055

(22) Filed: Jun. 13, 2017

(65) Prior Publication Data

US 2017/0274506 A1 Sep. 28, 2017

Related U.S. Application Data

(63) Continuation-in-part of application No. 14/666,292, filed on Mar. 23, 2015, now abandoned.

(51) Int. Cl.

| | |
|---|---|
| ***B25B 13/46*** | (2006.01) |
| ***B25G 1/10*** | (2006.01) |
| ***B25G 1/04*** | (2006.01) |
| *B25B 23/16* | (2006.01) |

(52) U.S. Cl.

CPC ..... *B25B 13/46* (2013.01); *B25G 1/043* (2013.01); *B25G 1/107* (2013.01); *B25B 23/16* (2013.01)

(58) Field of Classification Search

None

See application file for complete search history.

(56) References Cited

U.S. PATENT DOCUMENTS

| | | | | |
|---|---|---|---|---|
| 4,846,042 | A * | 7/1989 | Wetty | B25G 1/085 81/490 |
| 5,542,322 | A * | 8/1996 | Knox | B25B 13/461 81/177.6 |
| 7,168,345 | B1 * | 1/2007 | Hsieh | B25B 13/461 411/403 |
| 8,869,658 | B2 * | 10/2014 | Chou | B25G 1/007 403/322.4 |

* cited by examiner

*Primary Examiner* — Brian D Keller

(74) *Attorney, Agent, or Firm* — Rosenberg, Klein & Lee

(57) ABSTRACT

A finger ratchet tool includes a body having a top part on the top thereof, and a ratchet device connected to the underside of the body. The top part includes a tapered face in the outer periphery thereof. Two flanges extend radially from the top part. A connection portion extends from the body. A mounting member has a C-shaped collar which has an opening, and a rod is connected between two ends of the opening. A matching face is defined in the inner periphery of the C-shaped collar. Two recesses are defined in the C-shaped collar and each have two ends. The rod is pivotably connected to the connection portion, and the C-shaped collar is mounted to the top part to match the matching face with the tapered face. The flanges are engaged with the recesses.

1 Claim, 6 Drawing Sheets

FINGER RATCHET TOOL

BACKGROUND OF THE INVENTION

1. Fields of the invention

The present invention is a Continuation-In-Part application of applicant's former patent application number 14/666,292, filed on Mar. 23, 2015.

2. Descriptions of Related Art

The conventional finger ratchet tool generally includes a small body with a ratchet device connected thereto, and a bit is removably connected to the body so as to drive the bit. The conventional finger ratchet tool generally is a round tool so that the user holds the finger ratchet tool and rotates it to output torque. However, the diameter of the conventional finger ratchet tool is limited so that the user has to apply a significant force to rotate it. The small body usually makes the user feel uncomfortable after being used for a period of time.

U.S. Pat. No. 5,542,322 to Knox discloses a compact folding wrench which includes a head and a handle which is pivotably connected to the head by a pivot. The handle fully surrounds the head when the wrench is in fully closed position. The handle and the head are in 180 degree angle when the wrench is in fully-open position. The handle has a shelf on which the head is rested when the head is accommodated in the handle.

U.S. Pat. No. 4,846,042 to Wetty discloses a tool handle with a rotatable cap, wherein the cap is pivotably mounted to the body. The body includes recesses and the cap has flanges which are engaged with the recesses when the cap is mounted to the body. The engagement between the flanges and the recesses secure the cap to the body. When the cap is pivotably removed from the body, the flanges are disengaged from the recesses in the pivotal direction.

The present invention intends to provide a finger ratchet tool to eliminate the shortcomings mentioned above.

SUMMARY OF THE INVENTION

The present invention relates to a finger ratchet tool and comprises a body having a top part protruding from the top thereof. A ratchet device is connected to the underside of the body. The top part has a tapered face defined in the periphery thereof. Two flanges extend radially from the lower portion of the tapered face. A connection portion extends from the body and has a passage defined transversely therethrough. A mounting member has a C-shaped collar which has an opening, and a rod is connected between two ends of the opening. A matching face is defined in the inner periphery of the C-shaped collar. A space is formed within the C-shaped collar. Two recesses are defined in the inner periphery of the C-shaped collar and each have two ends. Multiple grip protrusions are formed on the outer periphery of the C-shaped collar. The rod is engaged with the passage to pivotably connect the C-shaped collar to the body. The C-shaped collar is mounted to the top part of the body, and the matching face is shaped to be matched with the tapered face. The flanges are engaged with the recesses and each are located between the two ends of the recess corresponding thereto.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
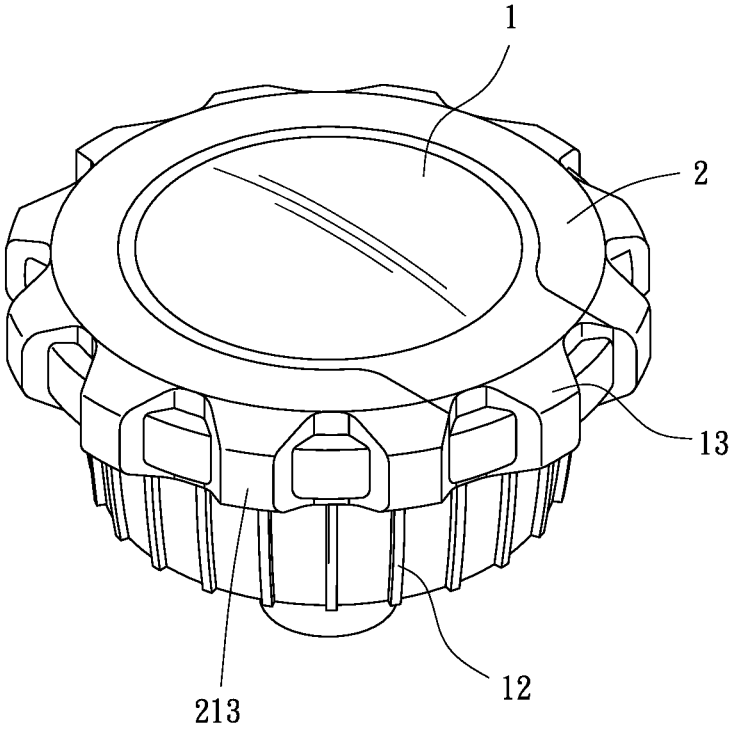
FIG. 1 is a perspective view to show the finger ratchet tool of the present invention.
Figure 2:
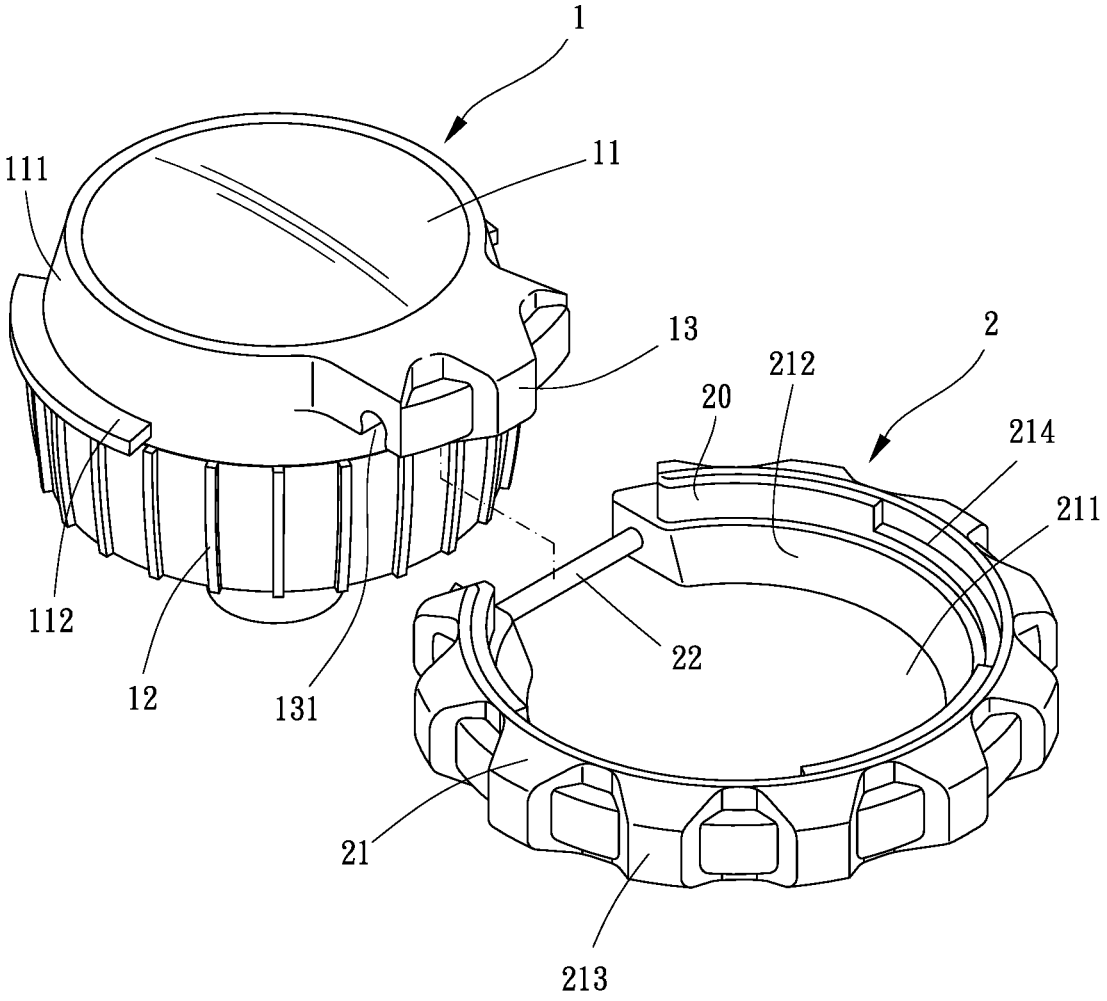
FIG. 2 is an exploded view of the finger ratchet tool of the present invention.
Figure 3A:
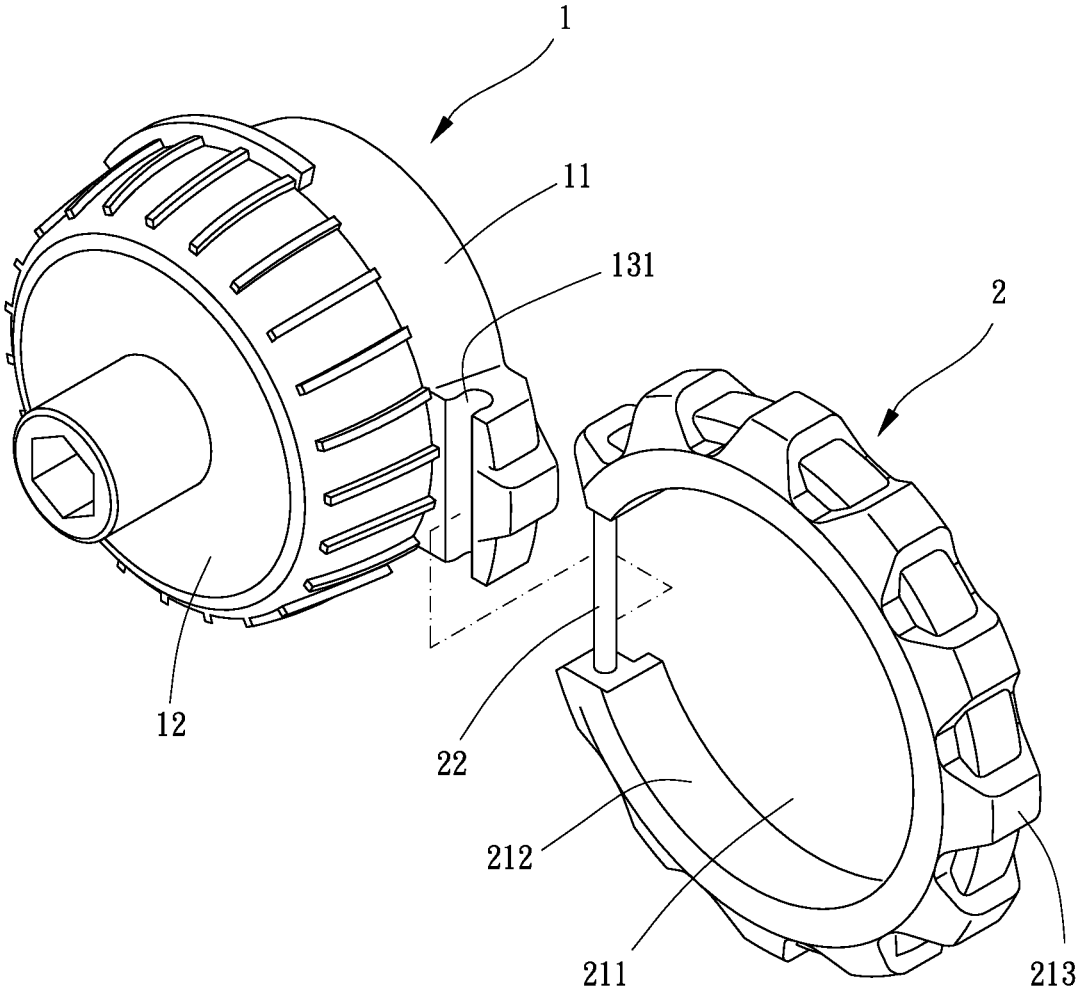
FIG. 3A shows that the C-shaped collar is to be pivotably connected to the body.
Figure 3B:
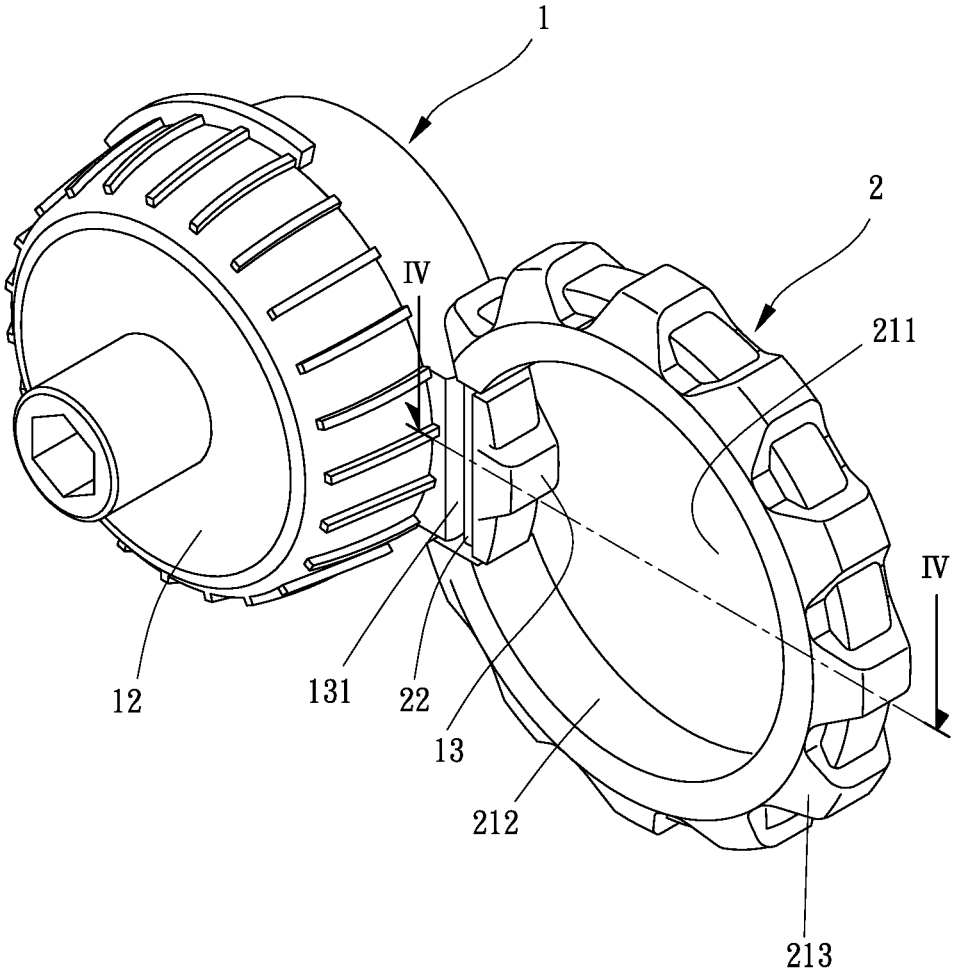
FIG. 3B shows that the C-shaped collar is pivotably connected to the body.
Figure 4:
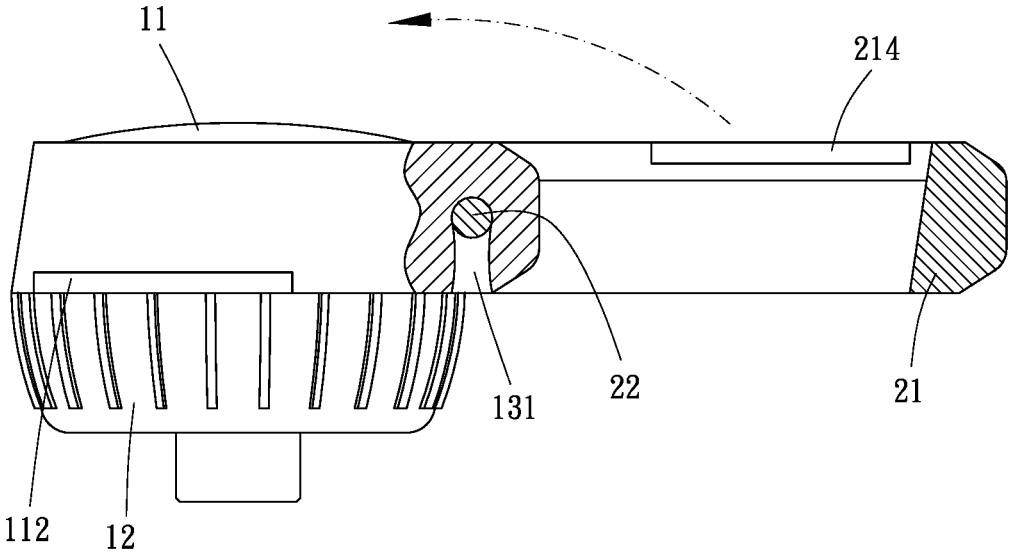
FIG. 4 is a cross sectional view, taken along line IV-IV in FIG. 3B.

Referring to FIGS. 1 to 2, the finger ratchet tool of the present invention comprises a body 1 having a top part 11 protruding from the top thereof. A ratchet device 12 is connected to the underside of the body 1 and has a connection part for being connected with a bit, for example. The top part 11 has a tapered face 111 defined in the outer periphery thereof. That is to say, the diameter of the upper portion of the tapered face 111 is smaller than the diameter of the lower portion of the tapered face 111. Two flanges 112 extend radially from the lower portion of the tapered face 111. A connection portion 13 extends from the body 1 and has a passage 131 defined transversely therethrough. The passage 131 opens through the underside of the connection portion.

A mounting member 2 comprises a C-shaped collar 21 which has an opening, and a rod 22 is connected between two ends of the opening. A matching face 212 is defined in the inner periphery of the C-shaped collar 21. A space 211 is formed within the C-shaped collar 21. A rib 20 extends axially from the first side of the C-shaped collar 21 and two recesses 214 are defined in the rib 20. Each recess 214 has two ends. Multiple grip protrusions 213 are formed on the outer periphery of the C-shaped collar 21.

As shown in FIGS. 3A, 3B, 4 and 5, when in use, the rod 22 is engaged with the passage 131 from the underside of the connection portion 13 to pivotably connect the C-shaped collar 21 to the body 1. The C-shaped collar 21 is then pivoted about the rod 22 and the first side having the rib 20 is mounted to the top part 11 so that the top part 11 is accommodated in the space 122 of the C-shaped collar 21. The second side of the C-shaped collar 21 to not have the rib as the first side. The matching face 212 is shaped to be matched with the tapered face 111 so as to have a larger contact area in the direction when the finger ratchet tool is pressed downward. The matching face 212 is matched with the tapered face 111 to provide an axial locking feature between the C-shaped collar 21 and the top part 11. The two flanges 112 are respectively engaged with the two recess 214. Each flange 112 is located between the two ends of the recess 214 corresponding thereto so that the engagement between the flanges 112 and the recesses 214 provide a radial locking feature between the C-shaped collar 21 and the body 1. The C-shaped collar 21 is co-rotated with the body 1 when the user rotates the combination of the C-shaped collar 21 and the body 1.

The user can easily grasp the C-shaped collar 21 by the grasp protrusions 213 so as to firmly operate the finger ratchet tool. Each of the flanges 112 is stopped by the two ends of each of the recesses 214 so that when rotating the C-shaped collar 21, the C-shaped collar 21 drives the body

1. The matching face 212 is matched with the tapered face 111, therefore, there is no gap between the tapered face 111 and the matching face 212 when the user applies a downward force to the C-shaped collar 21. This feature ensures that the body 1 is co-rotated with the C-shaped collar 21.

Figure 5:
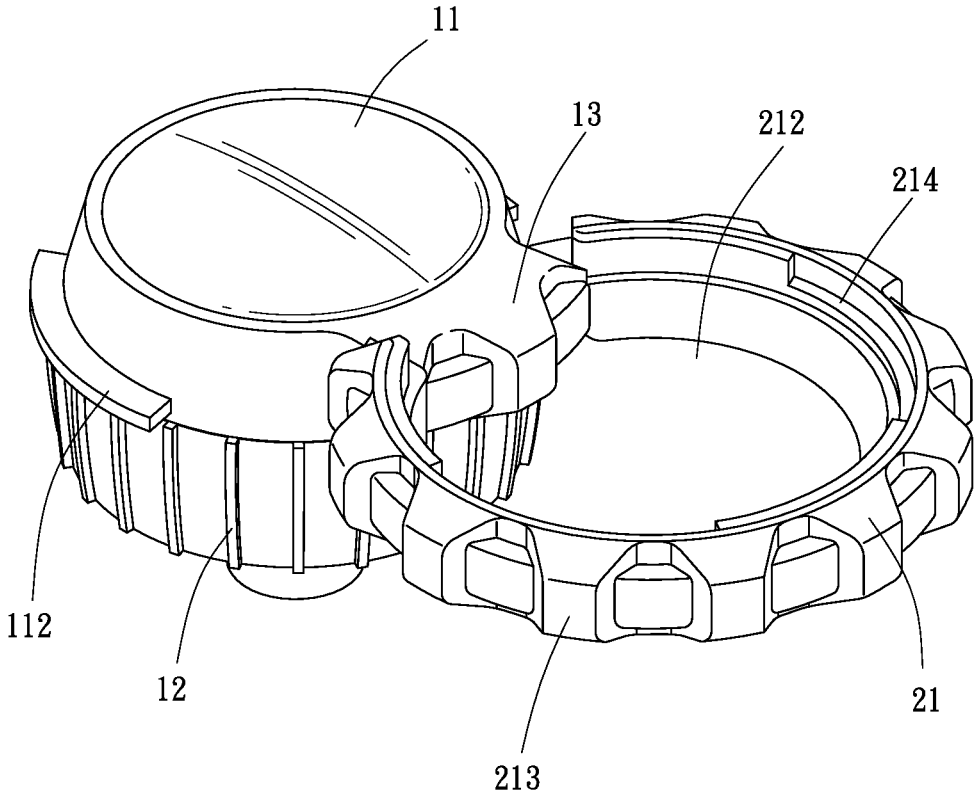
FIG. 5 shows another perspective view to show that the C-shaped collar is pivotably connected to the body.

As shown in FIG. 5, when the user wants to obtain a longer arm to rotate the finger ratchet tool, he/she can pivot the C-shaped collar 21 away from the body 1, and use the C-shaped collar 21 as a handle without extra part added.

It is noted that the combination of the C-shaped collar 21 together with the rod 22 is independent from the body 1, so that the two individual parts are easily manufactured. The present invention provide the axial locking feature and the radial locking feature between the body 1 and the C-shaped collar 21 to make the combination of the body 1 and the C-shaped collar 21 be secure and reliable. There will be no relative movement between the body 1 and the C-shaped collar 21 in axial and radial directions.

While we have shown and described the embodiment in accordance with the present invention, it should be clear to those skilled in the art that further embodiments may be made without departing from the scope of the present invention.

What is claimed is:

1. A finger ratchet tool comprising:

a body having a top part protruding from a top of the body, a ratchet device connected to an underside of the body, the top part having a tapered face defined in an outer periphery of the top part, a diameter of an upper portion of the tapered face being smaller than a diameter of a lower portion of the tapered face, at least one flange extending radially from the lower portion of the tapered face, a connection portion extending from the body and having a passage defined transversely therethrough, and a mounting member having a C-shaped collar which has an opening, a rod connected between two ends of the opening, a matching face defined in an inner periphery of the C-shaped collar, the matching face being tapered to be matched with the tapered face, a space formed within the C-shaped collar, a rib extending axially from a first side of the C-shaped collar and at least one recess defined in the rib of the C-shaped collar, the at least one recess having two ends, multiple grip protrusions formed on an outer periphery of the C-shaped collar, the rod engaged with the passage, when the C-shaped collar is pivoted about the rod and the first side of the C-shaped collar is mounted to the top part of the body, the matching face is matched with the tapered face to axially secure the matching face to the tapered face, no gap is formed between the matching face and the tapered face when the matching face abuts the tapered face, the at least one flange is engaged with the at least one recess and located between the two ends of the at least one recess to radially secure the C-shaped collar to the body, and to restrict axial and radial movement between the body and the C-shaped collar.

* * * * *